US010505263B2

(12) United States Patent
Xia

(10) Patent No.: US 10,505,263 B2
(45) Date of Patent: Dec. 10, 2019

(54) ELECTRONIC DEVICE

(71) Applicant: Lenovo (Beijing) Limited, Beijing (CN)

(72) Inventor: Yan Xia, Beijing (CN)

(73) Assignee: Lenovo (Singapore) Pte. Ltd., Singapore (SG)

( * ) Notice: Subject to any disclaimer, the term of this patent is extended or adjusted under 35 U.S.C. 154(b) by 220 days.

(21) Appl. No.: 15/469,521

(22) Filed: Mar. 25, 2017

(65) Prior Publication Data

US 2017/0279186 A1 Sep. 28, 2017

(30) Foreign Application Priority Data

Mar. 25, 2016 (CN) ..... 2016 1 0180335

(51) Int. Cl.
*H01Q 1/00* (2006.01)
*H01Q 1/50* (2006.01)
*H01Q 1/24* (2006.01)

(52) U.S. Cl.
CPC ..... *H01Q 1/245* (2013.01)

(58) Field of Classification Search
CPC ..... H01Q 1/24; H01Q 1/245; H01Q 1/00; H01Q 1/50; G06F 3/04817; G06F 3/04883; G06F 3/04886
See application file for complete search history.

(56) References Cited

U.S. PATENT DOCUMENTS 8,717,248 B2 * 5/2014 Tung ..... H01Q 5/335 333/32
8,749,444 B2 * 6/2014 Song ..... H03H 7/38 343/850
10,084,229 B2 * 9/2018 Nagumo ..... H01Q 1/243
2002/0105474 A1 * 8/2002 Kitamura ..... H01Q 9/30 343/850
2012/0119971 A1 * 5/2012 Bae ..... H04B 1/0458 343/860
2013/0210477 A1 8/2013 Peter
2014/0333494 A1 11/2014 Huang
2017/0310012 A1 * 10/2017 Wong ..... H01Q 9/0442
2018/0212313 A1 * 7/2018 Harper ..... H01Q 1/50

FOREIGN PATENT DOCUMENTS

CN 104704862 A 6/2015
CN 105340186 A 2/2016
CN 105406205 A 3/2016

* cited by examiner

*Primary Examiner* — Tho G Phan

(74) *Attorney, Agent, or Firm* — Ference & Associates LLC

(57) ABSTRACT

One embodiment provides an electronic device, comprising: an antenna structure comprising an antenna body and an antenna tuning circuit; an RF circuit coupled to the antenna structure via a first capacitor to transmit an RF signal through the antenna structure; a Specific Absorption Ratio (SAR) sensor coupled to the antenna structure via a first inductor to detect, through the antenna structure, a change of capacitance within a target range, wherein a second capacitor in the antenna tuning circuit is located within the target range; and a control circuit for outputting a control signal to the antenna tuning circuit to adjust the second capacitor in the antenna tuning circuit to match RF signals having different frequencies; wherein a power supply terminal of the control circuit is coupled to a constant voltage power source. Other aspects are described and claimed.

11 Claims, 4 Drawing Sheets

ELECTRONIC DEVICE

CLAIM FOR PRIORITY

This application claims priority to Chinese Application No. 201610180335.5 filed on Mar. 25, 2016 the contents of which is fully incorporated by reference herein.

TECHNICAL FIELD

The present subject matter described herein relates to the field of antenna technology, and in particular, to an electronic device having a multi-functional antenna.

BACKGROUND

Specific Absorption Ratio Sensor (SAR sensor) is a component that is used in many electronic devices, for example, mobile phones and tablet computers are equipped with an SAR Sensor. The SAR Sensor senses whether there is a change in capacitance around it through an antenna so as to determine whether there is a human body approaching the electronic device. When a human body is approaching the electronic device, the electronic device can be controlled to reduce transmitting power, thereby lowering the SAR value to decrease radiation toward the human body.

An antenna tuning circuit is also referred to as an antenna tuner, and is an impedance matching network connecting a transmitter and an antenna, which enables an impedance match between the transmitter and the antenna, thereby having the antenna exhibit a maximal radiation power at a certain frequency. An antenna tuning circuit comprises components such as a capacitor and an inductor, and the capacitor in the antenna tuning circuit is adjustable to enable the antenna to match with respect to various frequencies, thereby increasing the bandwidth of the antenna. Antenna tuning circuits are being used in more and more electronic devices.

BRIEF SUMMARY

In summary, one aspect provides an electronic device, comprising: an antenna structure comprising an antenna body and an antenna tuning circuit; an RF circuit coupled to the antenna structure via a first capacitor to transmit an RF signal through the antenna structure; a Specific Absorption Ratio (SAR) sensor coupled to the antenna structure via a first inductor to detect, through the antenna structure, a change of capacitance within a target range, wherein a second capacitor in the antenna tuning circuit is located within the target range; and a control circuit for outputting a control signal to the antenna tuning circuit to adjust the second capacitor in the antenna tuning circuit to match RF signals having different frequencies; wherein a power supply terminal of the control circuit is coupled to a constant voltage power source.

Another aspect provides an electronic device, comprising: a processor; a memory device that stores instructions executable by the processor to: transmit a signal of a first mode, using a first capacitor; detect a change of capacitance of the antenna within an antenna body; select the first capacitor or a second capacitor; and adjust the second capacitor to match a signal of an at least one different frequency.

A further aspect provides a method, comprising: transmitting, using an antenna, a signal of a first mode, using a first capacitor; detecting, using a processor, a change of capacitance of the antenna within an antenna body; selecting, using a control circuit, the first capacitor or a second capacitor; and adjusting, using an antenna tuning circuit, the second capacitor to match a signal of an at least one different frequency.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Generally, the antenna that corresponds to an antenna tuning circuit is considered the primary antenna. In consideration of the limited space in an antenna, the antenna of an SAR sensor and the primary antenna are combined together in use. However, when the antenna tuning circuit and the SAR sensor share a common antenna, interferences occur and one of the interferences is reflected as follows: when the antenna is operating in Global System for Mobile Communication (GSM) mode, the transmission of the antenna is not consecutive during the entire period of time due to its TDD (Time Division Duplexing) communication mode, so that a change in the capacitance of the adjustable capacitor in the antenna tuning circuit may result in a false triggering of the SAR sensor.

In order to achieve a thorough understanding of the features and technical contents of the embodiments, the implementation of the embodiments will be described below in detail by referring to the accompanying drawings. The accompanying drawings are used merely for reference, rather than for limiting the embodiments.

Figure 1:
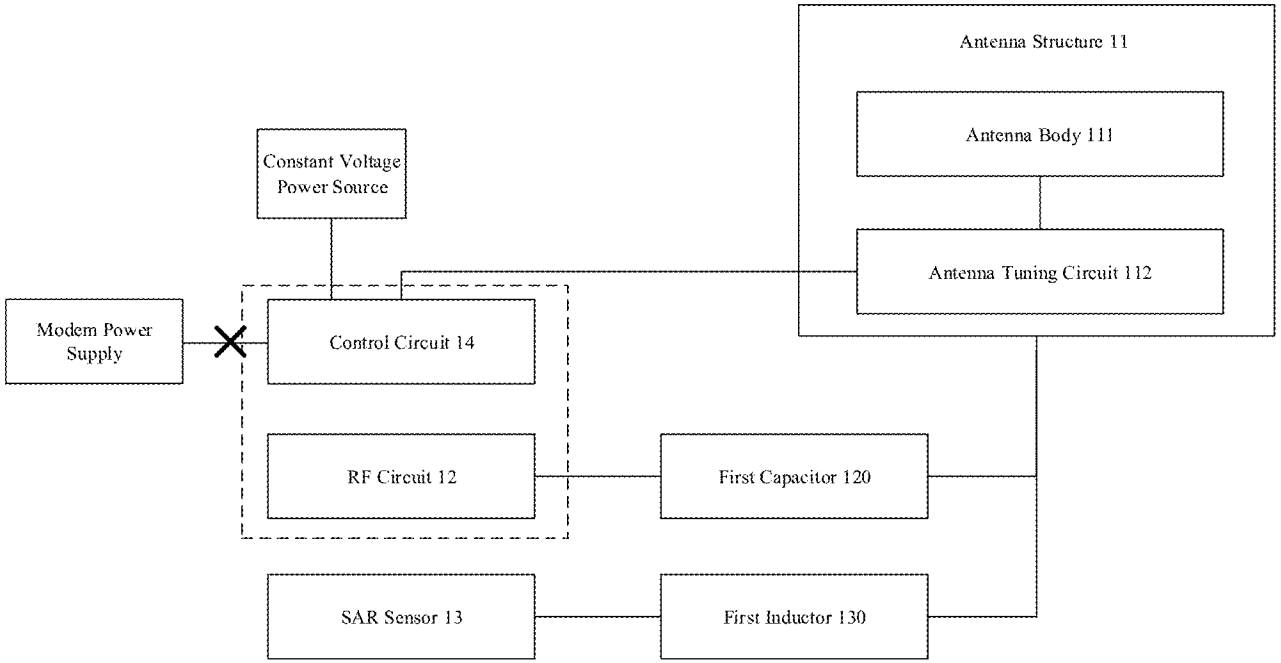
FIG. 1 is a structural schematic diagram illustrating an electronic device in accordance with an embodiment.

FIG. 1 is a schematic structural diagram of an electronic device according to an embodiment. As shown in FIG. 1, the electronic device comprises: an antenna structure 11 comprising an antenna body 111 and an antenna tuning circuit 112; an RF circuit 12 coupled to the antenna structure 11 via a first capacitor 120 to transmit an RF signal through the antenna structure 11; an SAR sensor 13 coupled to the antenna structure 11 via a first inductor 130 to detect, through the antenna structure 11, a change in capacitance within a target range, wherein a second capacitor in the antenna tuning circuit 112 is located within the target range; and a control circuit 14 for outputting a control signal to the antenna tuning circuit 112 to adjust the second capacitor in the antenna tuning circuit 112 to match RF signals having different frequencies; wherein a power supply terminal of the control circuit 14 is coupled to a constant voltage power source.

In an embodiment, the antenna structure 11 comprises an antenna body 111 and an antenna tuning circuit 112. Herein, the antenna body 11 has two functions: the first function is to radiate an RF signal outward, and the second function is to receive an RF signal propagated in the space. Take the antenna of a mobile phone as an example, the antenna body 111 is implemented by a sheet metal, and the structure of the antenna body 111 (for example, its area, length, width, thickness, etc.) will decide the frequency of the RF signal that can be transmitted through the antenna body 111. Antenna tuning circuit 112 comprises components such as a capacitor, an inductor. In an embodiment, the capacitor comprised in the antenna tuning circuit 112 is referred to as a second capacitor in order to being distinguished from the first capacitor 120. Antenna tuning circuit 112 is also referred to as antenna tuner, and is an impedance matching network between the RF circuit 12 and the antenna body 111.

In an embodiment, the RF circuit 12 is a circuit receiving and transmitting RF communications. The RF circuit 12 can transmit various types of RF signals, such as for example, RF signals from 2G, 3G, 4G. Here, the information such as the type of an RF signal is determined by a Modem which is also referred to as an RF chip. RF circuit 12 radiates an RF signal to the space or receives an RF signal therefrom through the antenna structure 11.

In an embodiment, the frequency of the RF signal transmitted to the antenna structure 11 from the RF circuit 12 is in the range between 698 MHz and 2,690 MHz, and thus the signal is a high-frequency signal. Based on this, the first capacitor 12 is connected in series between the RF circuit 12 and the antenna structure 11, and has a capacitance value of greater than, or equal to, 22 pF, which is equivalent to short circuit with regard to a high-frequency signal.

In an embodiment, SAR means the electromagnetic radiation energy absorbed by a material per unit mass per unit time, and it is generally used to evaluate the heat effect of radiation of an electronic device. Electronic devices, such as mobile phones, tablet computers, and the like, have a standard for limiting radiation power so that health of a human body can be protected. For this reason, the electronic device is provided with an SAR sensor 13 that is coupled with the antenna structure 11 and detects, through the antenna structure 11, whether there is a change in capacitance around the SAR sensor 13. If yes, the SAR sensor 13 determines that a human body is approaching the electronic device, and accordingly, triggers the Modem to reduce the transmitting power, thereby lowering the SAR value.

In an embodiment, the operating frequency of the SAR sensor 13 is about tens of MHz, and thus is classified as a low-frequency signal. Based on this, the first inductor 130 is connected in series between the SAR sensor 13 and the antenna structure 11, and has an inductance value of greater than, or equal to, 80 nH, which is equivalent to short circuit with regard to a low-frequency signal.

In summary, high-frequency signals and low-frequency signals can be separated by using the first capacitor 120 and the first inductor 130, with the first capacitor 120 being able to pass a high-frequency signal through, but unable to pass a low-frequency signal through. And the first inductor 130 being able to pass a low-frequency signal through, but unable to pass a high-frequency signal through. As such, the RF circuit 12 and the SAR sensor 13 will not interfere with each other.

In an embodiment, the control circuit 14 refers to the control circuit that adjusts the capacitance of the second capacitor in the antenna tuning circuit 112. The second capacitor in the antenna tuning circuit 112 is adjustable to enable the antenna to match with various frequencies, thereby increasing the bandwidth of the antenna.

In the case that the RF circuit 12 and the SAR sensor 13 share a same common antenna, an interference may occur. Take an antenna operating in GSM mode as an example, the transmission of the antenna will not be consecutive during the entire period of time due to the TDD communication mode, so that a change in the capacitance of the second capacitor in the antenna tuning circuit may result in a false triggering of the SAR sensor 13.

In particular, when the antenna is operating in GSM mode, only two of the eight slots of each frame are in the transmitting or receiving state, with the remaining six slots being in the idle state. When a slot is in the idle state, the Modem will go to sleep, and MIPI level signal (VIO) supplied by the Modem to the control circuit 14 will result in high level outputs and low level outputs at a time frequency of 2:6 with a delay on the order of us. Accordingly, the control circuit 14 will synchronously output voltage signals at a time frequency of 2:6 to control the capacitance value of the second capacitor in the antenna tuning circuit 112.

The sensitivity of the SAR sensor 13 is of 1 pF grade, which is a very high sensitivity. In this case, a change in the capacitance of the second capacitor will trigger a change in the SAR sensor 13 so that the SAR sensor 13 is with ON and OFF outputs at the same frequency, which notifies the Modem at the same frequency to reduce the RF power. Actual measurement shows that the GSM RF power swiftly switches between high power and low power, and thus a normal test cannot be performed.

Since in frequency division duplexing (FDD) mode the transmission of an RF signal is consecutive and MIPI level signal (VIO) will not disappear, the control circuit 14 will keep a fixed output voltage so that the second capacitor in the antenna tuning circuit 112 will not change due to power down. Based on this, a power supply terminal of the control circuit 14 is coupled to a constant voltage power source.

For example, a 1.8 V constant voltage power source may be introduced to the MIPI VIO pins of the control circuit 14 to supply the constant voltage thereto, thereby to simulate that it operates in FDD mode. As such, the control circuit 14 can output a constant voltage, thereby avoiding the false triggering of the SAR sensor 13.

Moreover, in the case of searching for a network, the Modem would also operate at an intermittent frequency for searching, and the second capacitor in the antenna tuning circuit 112 would change continuously to match the frequency so that it could not operate consecutively in a high-efficiency working state. However, providing a constant voltage to the control circuit 14 can keep it in a consecutive high-efficiency state when searching for a network, thereby increasing the network-searching efficiency under weak signal conditions.

Figure 2:
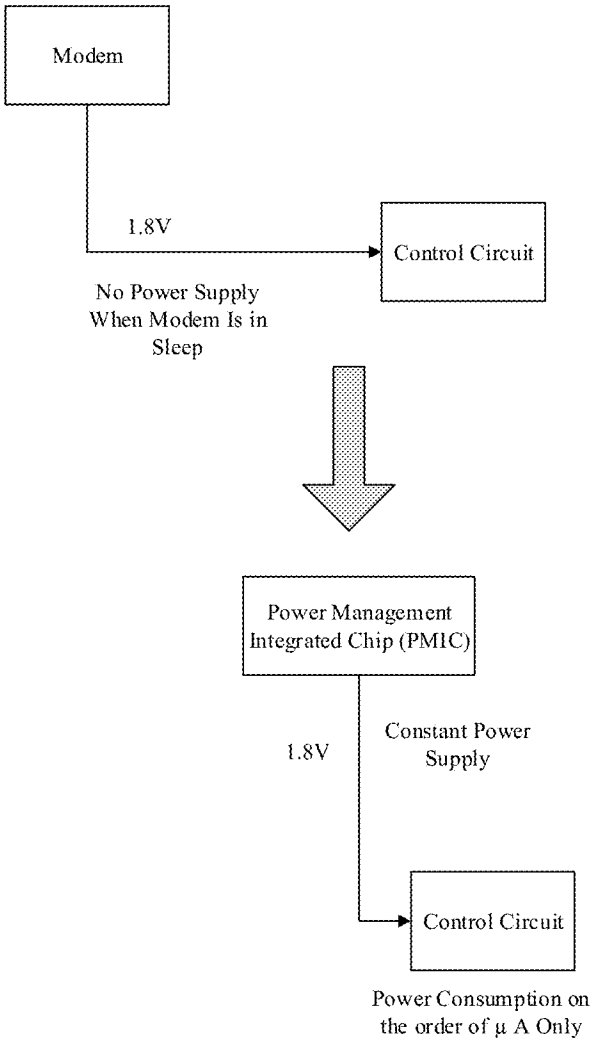
FIG. 2 is a structural schematic diagram illustrating an embodiment.

FIG. 2 is a circuit structural diagram according an embodiment. As shown in FIG. 2, the control circuit is able to send a control signal to the antenna tuning circuit so as to adjust the capacitance of the second capacitor in the antenna tuning circuit. The power supply port (VIO) for supplying power to the control circuit is originally coupled to the Modem, and when the Modem is in sleep, it will not supply power to the control circuit, and accordingly, the control circuit is in a power off state.

Here, the Modem supplies the control signals to the control circuit in three paths, i.e. data signal, sequence signal and power supply signal. In this example, the power supply signal supplied by the Modem to the control circuit is cut off, and the power supply signal supplied to the control circuit will be provided by a constant voltage power source. Here, the constant voltage power source may be implemented by a power management integrated circuit (PMIC). In a particular implementation, the power management integrated circuit provides a 1.8 V constant voltage to the control circuit.

Figure 3:
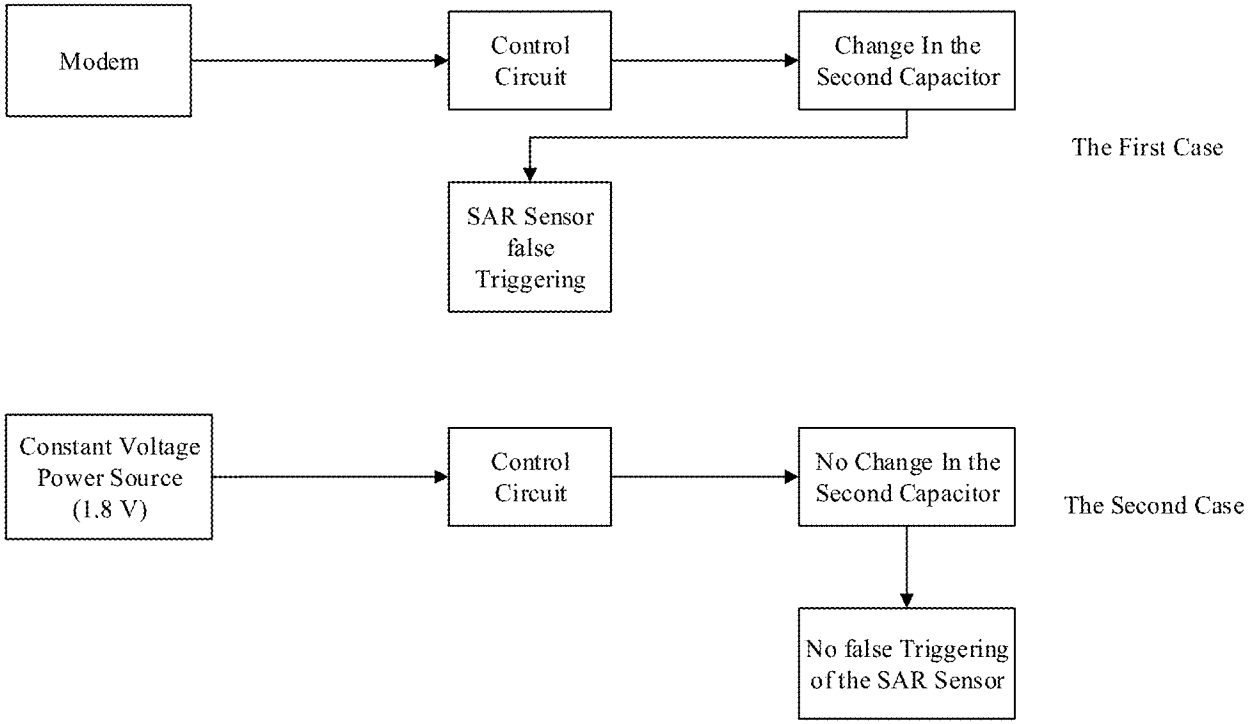
FIG. 3 is a schematic flow diagram illustrating an embodiment.

FIG. 3 is a signal control flow diagram according an embodiment. As shown in FIG. 3, in the first case, power is supplied to the control circuit by the Modem, and when the Modem is in sleep, the control circuit is power off, then the control circuit will trigger a change in the capacitance of the second capacitor in the antenna tuning circuit, and thus cause a false triggering of the SAR sensor. In the second case, the power of the control circuit is supplied by a constant voltage (1.8 V), and in this case, the control circuit will not trigger a change in the capacitance of the second capacitor in the antenna tuning circuit, i.e., the second capacitor will not change in capacitance and thus the SAR sensor will not be false-triggered.

Figure 4:
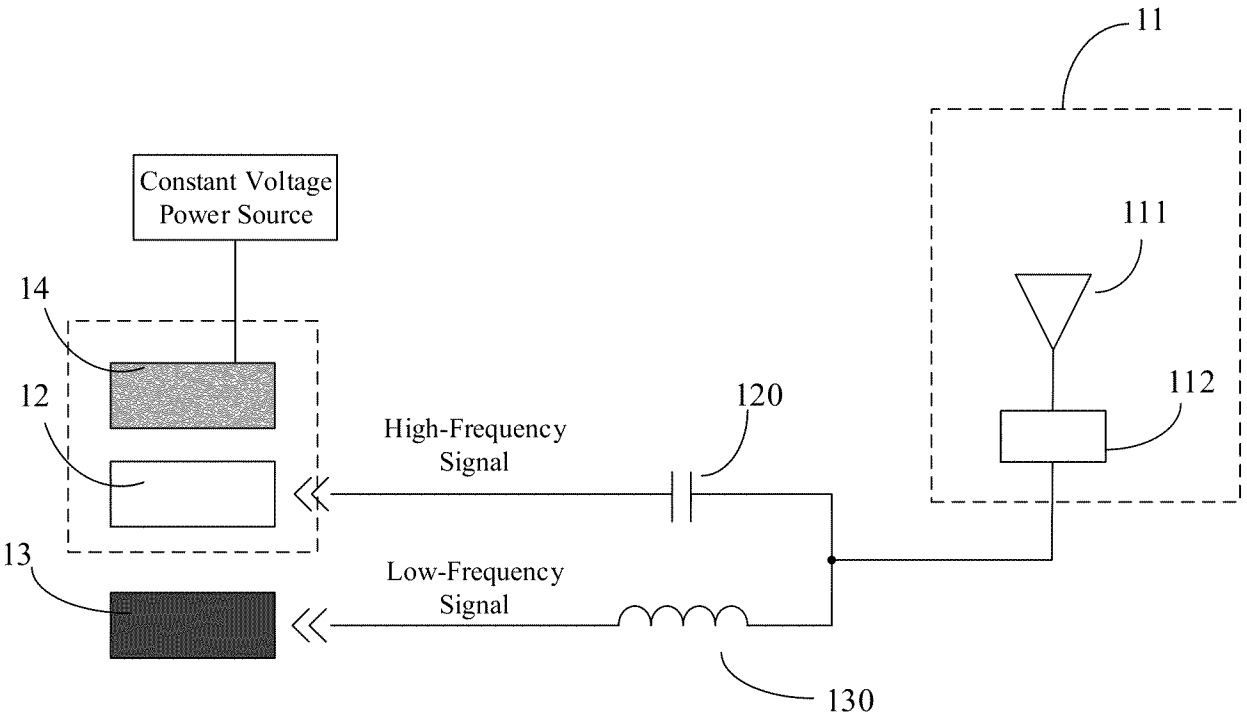
FIG. 4 is a structural schematic diagram of an electronic device illustrating an embodiment.

FIG. 4 is a structural schematic diagram of an electronic device according an embodiment. As shown in FIG. 4, the electronic device comprises: an antenna structure 11 comprising an antenna body 111 and an antenna tuning circuit 112; an RF circuit 12 coupled to the antenna structure 11 via a first capacitor 120 to transmit an RF signal through the antenna structure 11; an SAR sensor 13 coupled to the antenna structure 11 via a first inductor 130 to detect, through the antenna structure 11, a change in capacitance within a target range, wherein a second capacitor in the antenna tuning circuit 112 is located within the target range; and a control circuit 14 for outputting a control signal to the antenna tuning circuit 112 to adjust the second capacitor in the antenna tuning circuit 112 to match RF signals having different frequencies; wherein a power supply terminal of the control circuit 14 is coupled to a constant voltage power source, wherein when the power supply terminal of the control circuit 14 is coupled to the constant voltage power source, the control signal output by the control circuit 14 to the antenna tuning circuit 112 will keep the capacitance value of the second capacitor in the antenna tuning circuit 112 constant.

In an embodiment, the RF circuit 12 being coupled to the antenna structure 11 via a first capacitor 120 comprises: the RF circuit 12 being coupled to the antenna tuning circuit 112 and the antenna body 111 in sequence via the first capacitor 120; wherein: matching of different frequencies between RF circuit 12 and the antenna body 111 is performed by the antenna tuning circuit 112.

In an embodiment, the SAR sensor 13 being coupled to the antenna structure 11 via a first inductor 130 comprises: the SAR sensor 13 being coupled to the antenna tuning circuit 112 and the antenna body 111 in sequence via the first inductor 130.

In an embodiment, the capacitance value of the first capacitor is greater than, or equal to, a first threshold, and the inductance value of the first inductor is greater than, or equal to, a second threshold.

In an embodiment, when the capacitance value of the first capacitor 120 is greater than, or equal to, the first threshold, the first capacitor 120 can transmit an RF signal in a first frequency band and filter out an RF signal in a second frequency band; when the inductance value of the first inductor 130 is greater than, or equal to, the second threshold, the first inductor 130 can transmit an RF signal in the second frequency band and filter out an RF signal in the first frequency band; wherein the first frequency band is greater than the second frequency band.

In an embodiment, the RF signal is in the first frequency band, and the SAR sensor 13 operates in the second frequency band.

In an embodiment, the control circuit 14 and the RF circuit 12 are integrated on an RF chip.

The technical solutions described in the embodiments may be combined freely unless they are conflict with each other.

The above merely describes specific embodiments, and the protection scope of the present subject matter described therein is not limited thereto. Variations or substitutions that are within the technical scope of the present disclosure may be readily envisaged by those skilled in the art, and such variations or substitutions shall be covered by the protection scope of the embodiments.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, a system, apparatus, or device (e.g., an electronic, magnetic, optical, electromagnetic, infrared, or semiconductor system, apparatus, or device) or any suitable combination of the foregoing. More specific examples of a storage device/medium include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

The invention claimed is:

1. An electronic device, comprising:

a processor;

a memory device that stores instructions executable by the processor to:

transmit, using an antenna, a signal of a first mode, using a first capacitor;

detect, using the processor, a change of capacitance of the antenna within an antenna body;

select, using a control circuit, the first capacitor or a second capacitor; and adjust, using an antenna tuning circuit, the second capacitor to match a signal of an at least one different frequency.

2. The electronic device according to claim 1, wherein:

the antenna tuning circuit comprises a power supply terminal of the control circuit coupled to a constant voltage power source, a control signal output by the control circuit to the antenna tuning circuit to maintain the capacitance value of the second capacitor in the antenna tuning circuit constant.

3. The informational handling device according to claim 1, wherein the antenna tuning circuit comprises an RF circuit being coupled to the antenna body via the first capacitor further comprising:

the RF circuit being coupled to the antenna tuning circuit and the antenna body in sequence via the first capacitor, wherein the antenna tuning circuit matches different frequencies between the RF circuit and the antenna body.

4. The electronic device according to claim 1, wherein the antenna tuning circuit comprises an SAR sensor being coupled to the antenna body via a first inductor further comprising:

the SAR sensor being coupled to the antenna tuning circuit and the antenna body in sequence via the first inductor.

5. The electronic device according to claim 1, wherein the capacitance value of the first capacitor value is greater than, or equal to, a first threshold, and the inductance value of a first inductor is greater than, or equal to, a second threshold.

6. The electronic device according to claim 5, wherein a capacitance value of the first capacitor is greater than, or equal to, the first threshold, wherein the first capacitor transmits an RF signal in a first frequency band and filter out an RF signal in a second frequency band.

7. The electronic device according to claim 5, wherein an inductance value of the first inductor is greater than, or equal to, the second threshold, wherein the first inductor transmits an RF signal in the second frequency band and filter out an RF signal in the first frequency band, wherein the first frequency band is greater than the second frequency band.

8. The electronic device according to claim 7, wherein, the RF signal is in the first frequency band, and a SAR sensor operates in the second frequency band.

9. The electronic device according to claim 8, wherein the control circuit and a RF circuit are integrated on an RF chip.

10. A method, comprising:

transmitting, using an antenna, a signal of a first mode, using a first capacitor;

detecting, using a processor, a change of capacitance of the antenna within an antenna body;

selecting, using a control circuit, the first capacitor or a second capacitor; and adjusting, using an antenna tuning circuit, the second capacitor to match a signal of an at least one different frequency.

11. The method according to claim 10, wherein the antenna tuning circuit comprises a power supply terminal of the control circuit coupled to a constant voltage power source, and wherein a control signal output by the control circuit to the antenna tuning circuit maintains the capacitance value of the second capacitor in the antenna tuning circuit substantially constant.

* * * * *